US006523197B2

(12) United States Patent
Zitzmann

(10) Patent No.: US 6,523,197 B2
(45) Date of Patent: Feb. 25, 2003

(54) OPERATING TABLE FOR SURGICAL AND ANGIOGRAPHIC APPLICATIONS

(75) Inventor: Reinhard Zitzmann, Effeltrich (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/955,442

(22) Filed: Sep. 18, 2001

(65) Prior Publication Data

US 2002/0078504 A1 Jun. 27, 2002

(30) Foreign Application Priority Data

Sep. 18, 2000 (DE) ..... 200 16 235 U

(51) Int. Cl.[7] ..... A47B 13/00; A47B 71/00
(52) U.S. Cl. ..... 5/601; 5/600
(58) Field of Search ..... 5/600, 601

(56) References Cited

U.S. PATENT DOCUMENTS 4,101,120 A * 7/1978 Seshima ..... 378/209
4,503,844 A * 3/1985 Siczek ..... 5/11
4,506,872 A * 3/1985 Westerberg et al. ..... 378/209
4,616,813 A * 10/1986 McConnell ..... 5/600
4,653,482 A * 3/1987 Kurland ..... 5/601
4,669,136 A * 6/1987 Waters et al. ..... 177/144
4,916,725 A * 4/1990 Quinter et al. ..... 33/809
5,613,254 A * 3/1997 Clayman et al. ..... 5/172
6,027,247 A * 2/2000 Tachi et al. ..... 378/177
6,260,220 B1 * 7/2001 Lamb et al. ..... 5/601
6,295,671 B1 * 10/2001 Reesby et al. ..... 5/600
6,349,436 B1 * 2/2002 Kreuzer ..... 5/600

FOREIGN PATENT DOCUMENTS

DE 79 30 794 2/1980
DE 299 18 690 2/2000
EP 0 752 237 3/2000

OTHER PUBLICATIONS www.pemed.com/tables/tables.htm catalogue of used surgical tables, 16 pages, undated.*
OMI 7100 General Surgery Table, www.ohiomed.com/7100page.html and faxed page, 3 pages total, undated but available 1999 or earlier.*

* cited by examiner

*Primary Examiner*—J. J. Swann
*Assistant Examiner*—Katherine Mitchell
(74) *Attorney, Agent, or Firm*—Schiff Hardin & Waite

(57) ABSTRACT

An operating table for surgical and angiographic applications has a table top and lateral fastening rails for the releasable fastening of equipment by means of a rail clamping device. The table top of the operating table is provided with guide rails onto which moveable modules can be pushed, which are provided with fastening rails for rail clamping devices on at least two sides.

5 Claims, 3 Drawing Sheets

OPERATING TABLE FOR SURGICAL AND ANGIOGRAPHIC APPLICATIONS

FIELD OF THE INVENTION

The invention relates to an operating table of the type having a table top and lateral fastening rails for the releasable fastening of equipment by means of a rail clamping device.

DESCRIPTION OF THE PRIOR ART

European Application 752 237 describes an operating room table having a number of fastening rails fitted on all sides for accommodating surgical operating room equipment, for example mounts for surgical instruments, infusion holders, operating units for additional instruments, etc. Such mounts are held on the fastening rails, for example, by means of rail clamping devices. It is possible for them to be displaced easily on the fastening rails by the clamping device being released. The transition from one fastening rail to the other, however, is not so easily accomplished. The fastening rails also prove problematic if the operating table is to be used in the operating room not only for surgical purposes, but also for angiographic purposes.

SUMMARY OF THE INVENTION

An object of the present invention is to provide an operating table of the type described above which can easily be used for surgical and angiographic applications.

The object is achieved according to the invention in an operating table having a table top with guide rails onto which moveable modules can be pushed, which are provided with fastening rails for rail clamping devices on at least two sides. This allows the module to be easily removed and refitted and to be displaced over the entire length of the operating table, with the result that the equipment can be fitted at any desired location without gap-containing fastening rails posing problems.

The modules may have side parts and a base plate.

It has proven advantageous for the side parts, in the direction of the table top, to have guide grooves for accommodating the guide rails, and for the lateral fastening rails to be fitted on the outer sides via spacers.

A secure arresting operation can take place by introducing securing screws in the side parts.

It is also possible for equipment to be fitted releasably at the head side by providing a head module with a vertical fastening plate which connects the side parts and with a further fastening rail.

The guide rails can be fitted easily and without problem in any particular way if they are fitted beneath the table top of the operating table.

DESCRIPTION OF THE PREFERRED EMBODIMENTS

Figure 1:
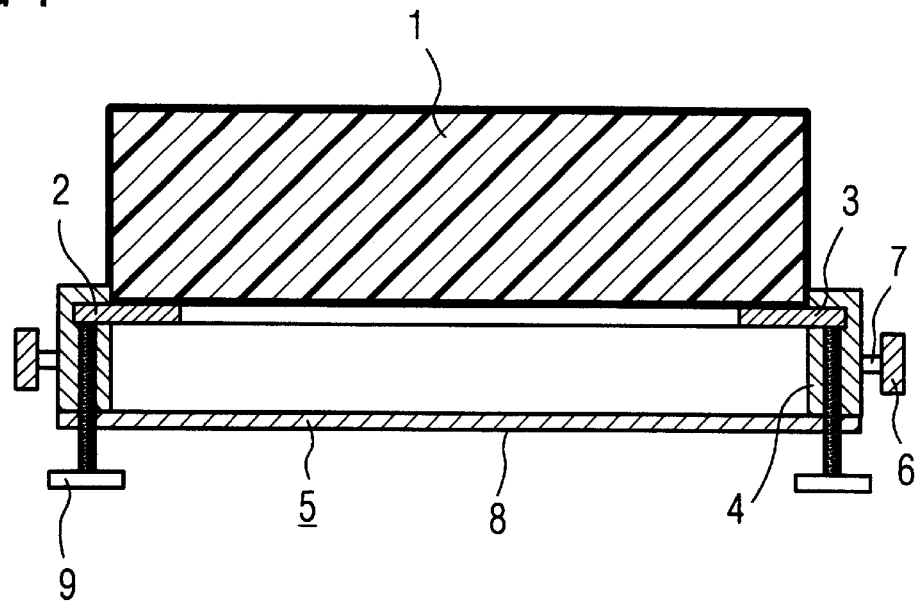
FIG. 1 shows a cross section through an operating table according to the invention, with a module.

FIG. 1 illustrates a table top i of an operating table, with guide rails 2 in which guide grooves 3 of side parts 4 of a U-shaped module 5 engage. Fastening rails 6 for rail clamping devices for the releasable fastening of equipment via spacers 7 are fitted on the side parts 4. The two side parts 4 are connected to one another by a base plate 8. Securing screws 9 are introduced into the side parts 4, so that the module 5, which can be displaced in the guide rails 2, can be arrested by the screws 9.

Figure 2:
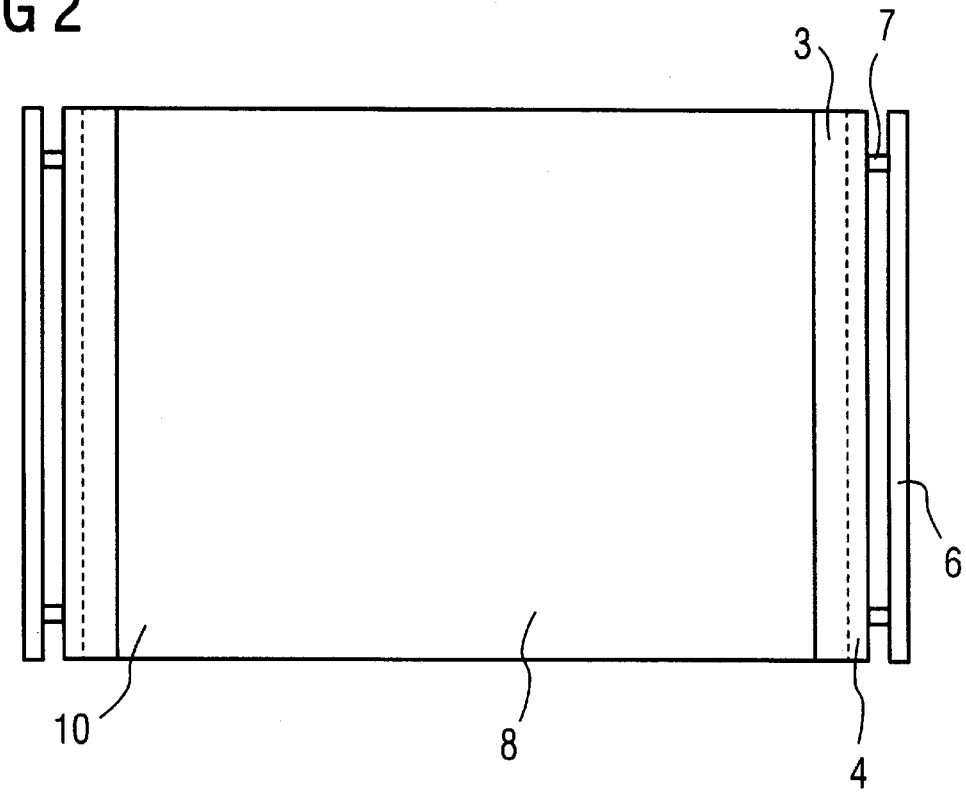
FIG. 2 shows a view of a body module for use in accordance with the invention.

FIG. 2 shows a plan view of a so-called body module 10, which corresponds to the module 5 outlined in cross section in FIG. 1. As is shown with reference to FIG. 4, the module 10 can be pushed to any location of the table top 1 of the operating table.

Figure 3:
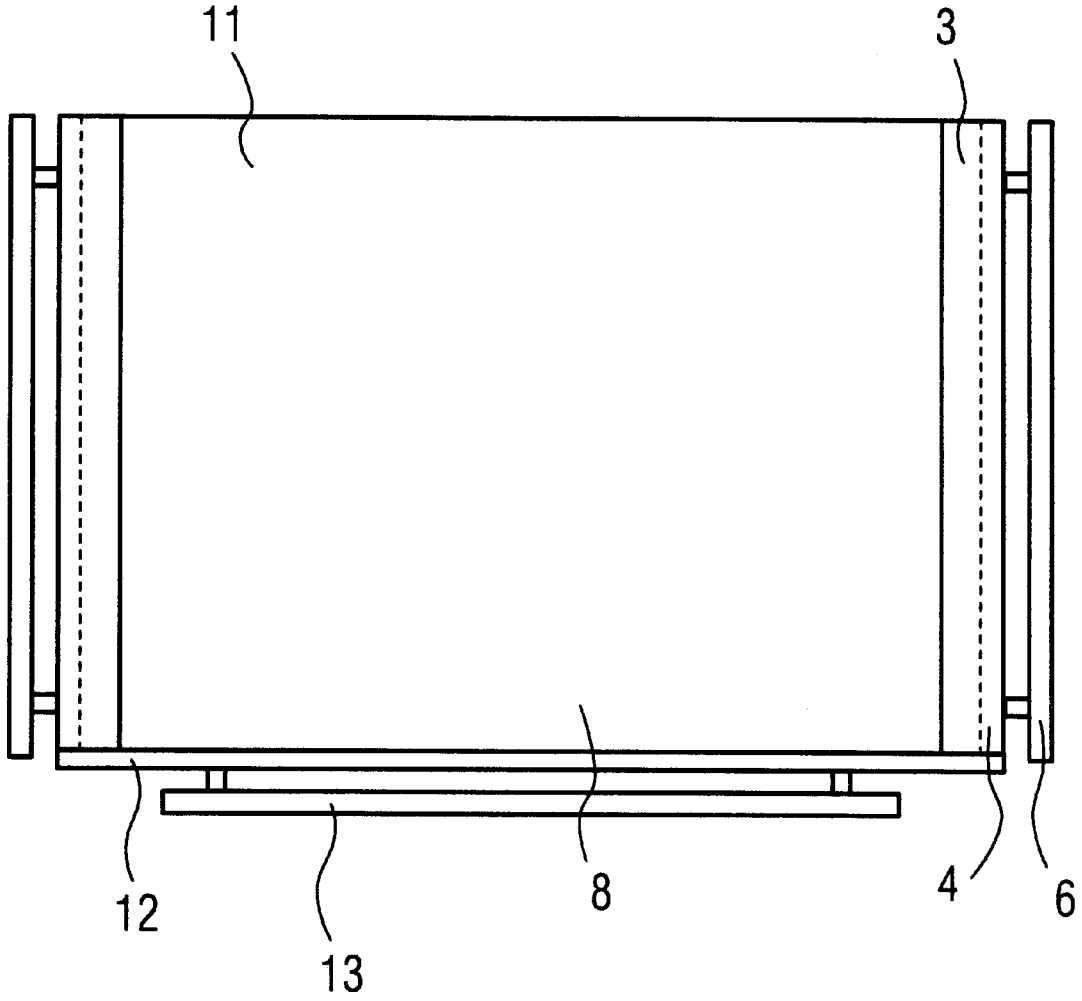
FIG. 3 shows a view of a head module for use in accordance with the invention.
Figure 4:
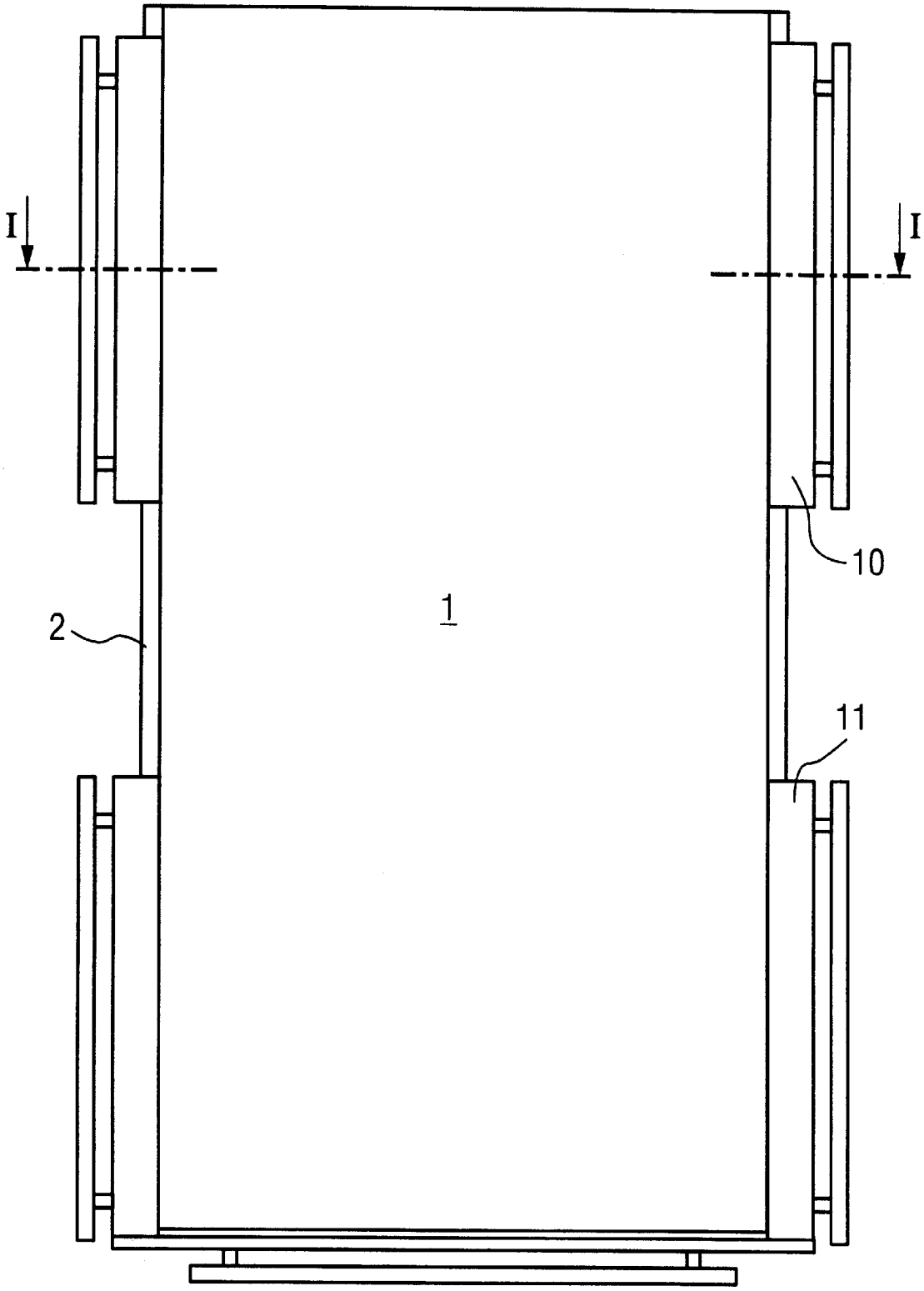
FIG. 4 shows a view of the operating table according to FIG. 1 with a body module according to FIG. 2 and a head module according to FIG. 3.

FIG. 3 illustrates a plan view of a so-called head module 11, which corresponds, in cross section, to the module 5 outlined in FIG. 1. In order for it also to be possible for equipment to be fitted at the head end, which may serve, for example, for accommodating the anaesthesia curtain for separating the anaesthesia region and surgical region and also for accommodating various mounts for ultrasound and infusion pumps, etc., a vertical fastening plate 12 is fitted on the side parts 4. The fastening plate 12 is provided with a further fastening rail 13. The head module 11 is bounded by the fastening plate 12 with the further fastening rail 13, with the result that, rather than it being possible for the head module 11 to be pushed, like the body module 10, to any desired location of the table top 1 of the operating table, the head module 11 is located only on the head part of the table top 1 of the operating table, as FIG. 4 shows.

The modules 5, 10 and 11 according to the invention, which can be fitted onto the table top 1 and have fastening rails 6 on both sides, may be positioned in an application-specific manner by the surgeon in order for it to be possible for the necessary equipment to be fastened. A distinction is made here between a head module 11 and a body module 10.

The head module 11 has fastening rails 6 and 13 on three sides. The body module 10 has fastening rails 6 on only two sides and can be freely positioned over the entire length of the table top in accordance with requirements.

The body module 10 is pushed onto the table top 1 from the head side and can be displaced over the entire radio transparent region of the operating table and fixed by means of the securing screws 9.

The head module 10 is likewise pushed onto the table top 1 from the head side, but is bounded by the third fastening rail 13 at the head end. This serves for accommodating the anaesthesia curtain for separating the anaesthesia region and surgical region and also for accommodating various mounts for ultrasound and infusion pumps, etc.

These two modules 10 and 11 fulfill the requirements of an operating-theatre table with fastening rails 6 and 13 all the way round and can easily be removed again for angiographic applications.

Although modifications and changes may be suggested by those skilled in the art, it is the intention of the inventor to embody within the patent warranted heron all changes and modifications as reasonably and properly come within the scope of his contribution to the art.

I claim as my invention:

1. An operating table comprising:

a tabletop having a plurality of sides;

guide rails respectively disposed at two opposite sides of said table top; and a module having a base plate with two opposite sides with side parts respectively joined to said base plate at said two opposite sides of said base plate so that said module has a U-shaped cross-section, said side parts being releasably connectible to said guide rails and movable along said guide rails to a selected position relative to said table top, said module having a plurality of sides and having fastening rails respectively disposed at at least two of said sides of said module, each fastening rail being adapted to receive a rail clamping device for releasably fastening medical equipment to that fastening rail.

2. An operating table as claimed in claim 1 wherein said side parts have guide grooves therein for respectively receiving said guide rails, with said fastening rails being laterally fitted thereon with spacers.

3. An operating table as claimed in claim 1 wherein said side parts have securing screws therein for releasable connection to said guide rails.

4. An operating table as claimed in claim 1 wherein said module is a head module having a vertical fastening plate connected to said side parts, and an additional fastening rail.

5. An operating table as claimed in claim 1 wherein said guide rails are disposed beneath said tabletop.

* * * * *